United States Patent [19]

Takagi

[11] 3,999,072

[45] Dec. 21, 1976

[54] BEAM-PLASMA TYPE ION SOURCE

[75] Inventor: Toshinori Takagi, Nagaokakyo, Japan

[73] Assignee: Sharp Kabushiki Kaisha, Osaka, Japan

[22] Filed: Oct. 23, 1975

[21] Appl. No.: 625,040

[30] Foreign Application Priority Data

Oct. 23, 1974 Japan ..... 49-123213

[52] U.S. Cl. ..... 250/427; 315/111.9

[51] Int. Cl.[2] ..... H01J 7/24; H01J 27/00; H05B 31/26

[58] Field of Search ..... 250/427; 313/161; 315/111.9

[56] References Cited

UNITED STATES PATENTS 3,171,053 2/1965 Targ et al. ..... 250/427

FOREIGN PATENTS OR APPLICATIONS 849,565 9/1960 United Kingdom ..... 315/111.9

*Primary Examiner*—Alfred E. Smith
*Assistant Examiner*—T. N. Grigsby
*Attorney, Agent, or Firm*—Birch, Stewart, Kolasch & Birch

[57] ABSTRACT

A beam-plasma type ion source comprises a first section for generating an electron beam, a cylindrical second section for ionizing a gas by virtue of electron bombardment caused by the electron beam generated from the first section, a microwave energy transmission circuit disposed in the second section and connected to receive microwave energy in order to cause plasma ionization, and a third section for collecting the electron beam. The gas introduced into the third section is ionized at the second section and extracted by and accelerated in the first section in the opposite direction to the electron beam way. The first section functions to converge an ion beam to generate a well-focused ion beam toward a desired target by means of ions trapped into a negative-potential well due to the electron beam.

10 Claims, 1 Drawing Figure

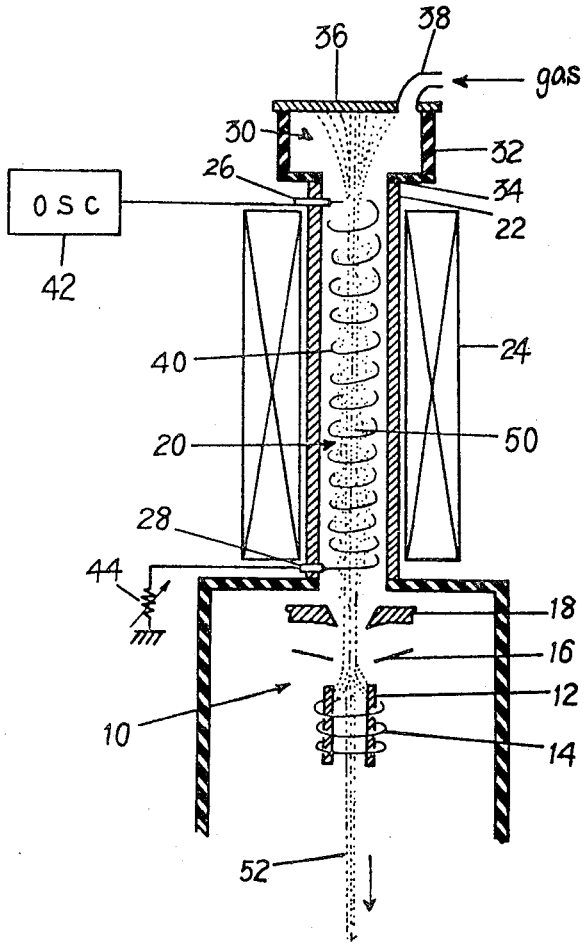
36
38
gas
30
32
26
34
OSC
22
42
40
24
20
50
28
44
18
16
12
10
14
52

BEAM-PLASMA TYPE ION SOURCE

BACKGROUND OF THE INVENTION

The present invention relates to an ion source for stably generating a well-focused ion beam of, especially, multicharged ions.

Two ways have been proposed in the art for generating multiply-charged ions. Electrons included in an atom are successively stripped off in one method, whereby the number of the valence is increased one by one, namely, in the order of one-charged, two-charged, . . . , seven-charged, and eight-charged, . . . , whereas a plurality of electrons are torn off at one time in another method.

The latter method is not effective since the creation of the multicharged ions is of low probability. It is of great importance in the former method that ionized particles come into collision with electrons of high velocity before they come into collision with uncharged particles in order to produce multiply-charged ions. It is, therefore, required that the particles have a long mean free path and the ionization is performed in a considerably high vacuum. The conventional ion source did not fulfill the above requirements, because the conventional ion source was operable under the gas pressure of $10^{-2} - 10^{-4}$ Torr. The ionization must be carried out under the gas pressure of $10^{-6} - 10^{-10}$ Torr. That is, the gas pressure suitable for the normal glow discharge and the arc discharge is not available.

OBJECTS AND SUMMARY OF THE INVENTION

Accordingly, an object of the present invention is to provide an ion source for stably generating multiply-charged ions.

Another object of the present invention is to provide an ion source for stably generating a well-focused ion beam.

Still another object of the present invention is to provide a beam-plasma type ion source for stably generating a well-focused ion beam of multiply-charged ions.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objectives, an embodiment of the beam-plasma type ion source of the present invention comprises a first section for generating an electron beam, a cylindrical second section for ionizing a gas by virtue of electron bombardment caused by the electron beam generated from the first section, a microwave energy transmission circuit disposed in the second section and connected to receive microwave energy in order to cause plasma ionization, and a third section for collecting the electron beam.

A multicharged ion beam is effectively generated by virtue of the electron bombardment caused by the electron beam and the microwave heating. The multicharged ion beam is extracted and accelerated in the opposite direction to the electron beam way by trapping the ions into a negative-potential well formed by the electron beam.

BRIEF DESCRIPTION OF THE DRAWING

The present invention will become more fully understood from the detailed description given hereinbelow and the accompanying drawing which is given by way of illustration only, and thus is not limitative of the present invention.

The single drawing is a sectional view of an embodiment of an ion source of the present invention.

DESCRIPTION OF THE PREFERRED EMBODIMENT

Referring now to the drawing, there is illustrated an embodiment of a beam-plasma type ion source of the present invention, which mainly comprises a first section 10 for generating an electron beam 50 and for extracting and converging an ion beam 52, a second section 20 for ionizing gaseous material by virtue of electron bombardment caused by the electron beam 50 generated from the first section 10, a microwave energy transmission circuit 40 disposed in the second section 20 and connected to receive microwave energy in order to cause plasma ionization, and a third section 30 for collecting the electron beam 50.

The first section 10 includes a cathode cylinder 12, filament windings 14 disposed around the cathode cylinder 12, a Wehnelt electrode 16 and an anode 18. The cathode cylinder 12 is heated up to a temperature sufficient to emit thermoelectrons by bombardment of electrons from the filament windings 14. The Wehnelt electrode 16 is kept at a voltage potential identical with that of the cathode cylinder 12 or slightly higher than, namely, slightly positive with respect to the cathode cylinder 12. The anode 18 is kept at a positive voltage potential with respect to the cathode cylinder 12, for example, at 10–50 KV. The cathode cylinder 12, the Wehnelt electrode 16 and the anode 18, in combination, form an electrostatic lens system, which extracts electrons from the upper portion of the cathode cylinder 12. The electrons are converged and accelerated into an electron beam 50, which is introduced into the second section 20.

The second section 20 mainly comprises a drift tube 22 of a hollow cylinder configuration and is made of metal or an insulating material, the drift tube 22 functioning as a casing of a vacuum oven. The drift tube 22 is kept at a voltage potential identical with that of the anode 18 or higher than the anode 18 by several kilovolts. A magnet coil 24 is preferably secured around the drift tube 22 in order to effectively focus the electron beam 50. The microwave energy transmission circuit 40 such as a helical wave delay circuit or a filter type wave delay circuit is disposed in the drift tube 22 and connected to receive microwave energy of, for example, 0.5–30 GHz frequency and several watts to several kilowatts output from a microwave oscillator 42 through a bushing 26 provided at a desired position of the drift tube 22.

Rushing electrons in the second section 20 come into collision with gas molecules or atoms to ionize the gas molecules or the atoms. The microwave energy functions to enhance the movement of the electrons and, therefore, the ionization is effectively performed to produce multiply-charged ions of which the valence number is 2–10. The microwave energy, after heating operation, is led out to a matched dummy load 44 through a bushing 28 provided at a desired position of the drift tube 22.

The third section 30 comprises a cylinder wall 32, an annular insulating plate 34, a collector 36 and a gas inlet 38 for introducing gaseous material to be ionized. The collector 36 is maintained at a voltage potential identical with that of the drift tube 22 or higher than the drift tube 22 by several hundreds of volts to several kilovolts in order to collect the electrons after they pass through the drift tube 22. The gas introduced through the gas inlet 38 is filled in the third section 30 and the second section 20 and held at a gas pressure of $10^{-6}$ – $10^{-10}$ Torr, which is suitable for producing multi-charged ions.

The electron bombardment and the microwave heating are superimposed to effectively generate the multiply-charged ions in the second section 20. Since the electron beam 50 comprises electrons bearing the negative potential, a negative potential trough is formed through the center of the electron beam 50. The multi-charged ions formed in the drift tube 22, having the positive potential, are trapped into the negative potential trough and accelerated in the opposite direction to the electron beam 50 and, thereafter, emitted through the cathode cylinder 12 toward a desired target (not shown) as the well-focused ion beam 52.

When singlecharged ions are desired to be obtained, the gas pressure in the second section 20 is selected at, for example, $10^{-2}$ – $10^{-3}$ Torr. The ionization is effectively achieved by virtue of the beam-plasma ionization.

The ion source of the present invention can endure long-time use since the first section 10 inclusive of the cathode cylinder 12 is maintained at a high vacuum and the gas ions will not come into collision with the cathode cylinder 12, the Wehnelt electrode 16 and the anode 18.

The invention being thus described, it will be obvious that the same way be varied in many ways. Such variations are not to be regarded as a departure from the spirit and scope of the invention, and all such modifications are intended to be included within the scope of the following claims.

What is claimed is:

1. A beam-plasma type ion source comprising:

a. a first section for generating an electron beam;

b. a second section for ionizing a gas by virtue of electron bombardment caused by the electron beam generated from the first section;

c. a microwave oscillator;

d. a microwave energy transmission circuit disposed in the second section and connected to receive microwave energy from the microwave oscillator in order to cause plasma ionization;

e. a third section for collecting the electron beam; and f. a gas inlet provided at the third section for introducing gaseous material to be ionized, whereby an ion beam is extracted through the first section by trapping the ions into a negative-potential trough formed in the electron beam.

2. The beam-plasma type ion source of claim 1, wherein the second section is maintained at a gas pressure of $10^{-6}$ – $10^{-10}$ Torr.

3. The beam-plasma type ion source of claim 1, wherein the second section is surrounded by a cylindrical drift tube made of metal.

4. The beam-plasma type ion source of claim 1, wherein the first section comprises a cathode cylinder, filament windings disposed around the cathode cylinder, a Wehnelt electrode and an anode, which, in combination, form an electrostatic lens system.

5. The beam-plasma type ion source of claim 1, wherein the third section comprises a cylinder wall, an annular insulating plate for providing a boundary area between the second section and the third section, and a collector for collecting the electron beam.

6. The beam-plasma type ion source of claim 1 further comprising a magnet coil secured around the second section for converging the electron beam.

7. The beam-plasma type ion source of claim 1, wherein the microwave energy transmission circuit is a helical wave delay circuit.

8. The beam-plasma type ion source of claim 1, wherein the microwave energy transmission circuit is a filter type wave delay circuit.

9. The beam-plasma type ion source of claim 1, wherein the second section is surrounded by a cylindrical drift tube made of insulating material.

10. The beam-plasma type ion source of claim 1, wherein the microwave oscillator generates microwave energy of 0.5 – 30 GHz frequency at the output intensity of several watts to several kilowatts.

* * * * *